US005411156A

United States Patent [19]

Reckamp

[11] Patent Number: 5,411,156

[45] Date of Patent: May 2, 1995

[54] PACKAGE HAVING CONTENT IMMOBILIZING DEVICE

[76] Inventor: Christopher J. Reckamp, 1764 N. Clark St., Chicago, Ill. 60614

[21] Appl. No.: 209,596

[22] Filed: Mar. 10, 1994

Related U.S. Application Data

[63] Continuation of Ser. No. 907,384, Jul. 1, 1992, abandoned.

[51] Int. Cl.[6] ..... B65D 39/16

[52] U.S. Cl. ..... 215/231; 215/296; 215/305; 215/355; 220/578; 220/579

[58] Field of Search ..... 215/231, 227, 295, 305, 215/341, 348, 355, 303, 296, 298, 299; 220/578, 579; 206/523, 584, 591, 540, 278, 292, 294, 296; 24/72.7, 704.2, 716, 13, 904, 907; 40/662, 664

[56] References Cited

U.S. PATENT DOCUMENTS

| | | | |
|---|---|---|---|
| 37,249 | 12/1862 | Towers | 215/355 |
| 139,905 | 6/1873 | Lyon | 215/355 X |
| 523,972 | 8/1894 | Butterfield | 215/296 |
| 1,084,114 | 1/1914 | Scheier | 215/231 |
| 1,183,714 | 5/1916 | Armstrong | 215/231 |
| 1,324,485 | 12/1919 | Watt | 215/299 |
| 2,088,678 | 8/1937 | Wylie . | |
| 2,091,212 | 8/1937 | McNeil . | |
| 2,222,042 | 11/1940 | Nitardy et al. . | |
| 2,833,398 | 5/1955 | Marshall . | |
| 2,857,068 | 10/1958 | Kraepelin . | |
| 2,880,900 | 4/1959 | Foye . | |
| 3,010,570 | 11/1961 | Sundstrom . | |
| 3,075,667 | 1/1963 | Lind | 215/231 |
| 3,103,666 | 9/1963 | Bone . | |
| 3,310,272 | 3/1967 | Brünger | 248/339 |
| 3,765,110 | 10/1973 | Olsen | 24/711.1 X |
| 3,863,795 | 2/1975 | Mills . | |
| 4,279,351 | 7/1981 | Vertes . | |
| 4,483,451 | 11/1984 | Gorski | 215/296 |
| 4,485,917 | 12/1984 | Smith | 206/278 |
| 4,589,583 | 5/1986 | Kunreuther et al. | 227/43 |
| 4,601,417 | 7/1986 | Kunreuther | 223/85 |
| 4,654,935 | 4/1987 | Bone | 40/662 X |
| 4,685,579 | 8/1987 | Stapleton | 215/230 |
| 4,782,967 | 11/1988 | Thomas . | |
| 4,890,753 | 1/1990 | Duryee et al. . | |
| 4,939,823 | 7/1990 | Klein | 24/590 |
| 5,014,957 | 5/1991 | Nichol, Jr. | 223/85 X |
| 5,096,078 | 3/1992 | McQueeny . | |
| 5,261,580 | 11/1993 | Smith | 223/85 |

FOREIGN PATENT DOCUMENTS

| | | |
|---|---|---|
| 823016 | 9/1969 | Canada . |
| 1339263 | 8/1967 | France . |
| 31316 | 4/1965 | German Dem. Rep. . |
| 562398 | 5/1957 | Italy . |
| 638762 | 6/1950 | United Kingdom . |

OTHER PUBLICATIONS

Sure-Fire (TM) Tag Attacher Sales Brochure for Price Tag Fasteners, Monarch Marking—1985.

*Primary Examiner*—Allan N. Shoap
*Assistant Examiner*—Vanessa Caretto
*Attorney, Agent, or Firm*—Christopher J. Reckamp

[57] ABSTRACT

A content immobilizer includes an immobilizing medium, such as cotton, and a plastic integrally formed pull member, operatively coupled through the immobilizing medium, wherein the pull member has a flexible portion adapted to resiliently extend above an upper rim surface of the mouth of a bottle after removal of the closure. The pull member may also laterally compress and expand to frictionally engage with an interior wall surface of the bottle to secure the pull member in a predetermined position. A method for forming the content immobilizer includes inserting the pull member through the immobilizing medium, inserting the content immobilizer into the bottle such that at least a portion of the pull member extends out through the mouth of the bottle, and applying a closure, such as a tamper evident seal, a cap and/or both, over the mouth such that the portion of the pull member resiliently couples to a bottom surface of the closure.

5 Claims, 3 Drawing Sheets

PACKAGE HAVING CONTENT IMMOBILIZING DEVICE

This is a continuation of copending application Ser. No. 07/907,384, filed on Jul. 1, 1992.

FIELD OF INVENTION

The invention relates generally to devices and methods for immobilizing contents in containers and more particularly to devices and methods for immobilizing pills, tablets, or other breakable contents in bottles.

BACKGROUND OF THE INVENTION

Content immobilizing devices are known which include handle or closure devices for coupling to an immobilizing medium, such as cotton, inside pill or tablet bottles to facilitate removal of the immobilizing medium. For example, U.S. Pat. No. 4,782,967 discloses a device for simultaneously removing the immobilizing medium and a tamper evident seal, such as a inner foil or paper seal, in one action. However, this device requires numerous manufacturing steps to implement. The pull cord typically must be preformed in a circle and partially attached to a bottom surface of the foil seal and also must be glued to the immobilizing medium. In addition, an end portion of the pull cord must be positioned to penetrate the tamper evident seal during assembly which frustrates the purpose of having a tamper evident foil seal since the device introduces a hole or aperture at the point where the pull cord penetrates the foil seal. A hole in the seal typically indicates evidence of tampering.

Other known content immobilizing devices require attachment of the immobilizing medium to the closure so that removal of the closure extracts the immobilizing medium from the bottle. For example, U.S. Pat. Nos. 2,857,068, 2,222,042, and 2,091,212 discloses various closures to which the immobilizing medium is affixed to the closure to facilitate removal of the immobilizing medium when the closure is removed. Such closures include metal straps, jaws, cork screws, slotted horizontal disks, and slotted plates or slots or apertures all penetrating into or through the surface of the closure. Such devices are typically not suitable for use with conventional closure systems using a thin tamper evident seal since each requires the seal to be penetrated.

Also these devices are not suited for conventional packaging processes in which the sealing process attaches the inner seal and cap simultaneously. In such processes, the seal is first secured to a bottom under surface of the cap by the cap supplier. The cap and inner seal are then simultaneously placed on the bottle. The inner seal is then secured to the rim of the bottle by some heating technique, glue, or pressure sensitive adhesive. Such devices would require the cap supplier to alter the cap and seal combination and may also adversely affect the sealing process.

Another problem with known content immobilizers concerns the relative inaccessibility of the handle or pull grip after removal of the closure. Arthritic patients or tablet users with larger diameter fingers have greater difficulty removing cotton from the inside of the bottles or gripping a handle which lies inside the neck of the bottle. Therefore, out-of-bottle access to the content immobilizer would be advantageous to overcome these types of problems. However, known devices which attempt to provide out-of-bottle access to the content immobilizer typically require the closure to be attached to the immobilizing medium. A problem arises since these devices are generally not compatible with conventional closure systems which use typical caps and bottles and require a tamper evident inner seal to cover the mouth of the bottle. Substantial redesign of packages and package manufacturing equipment would be required.

Other devices, such as disclosed in U.S. Pat. No. 2,091,212, rely on the amount of immobilizing medium inside the bottle to insure that the handle or grip device is proximate the opening of the bottle. However, such devices and attachment methods would not be effective where the immobilizing medium only extends as high as the shoulder of the bottle. Also, such a device generally has a flat grip surface and does not provide a readily grippable area for receiving a finger or other removal device.

Another content immobilizer disclosed in U.S. Pat. No. 2,088,678 uses a metal wire bent in a loop at its intermediate portion to form a handle and having the remaining end portions bent to surround the immobilizing medium. The wire is secured to the immobilizing medium by twisting the distal ends of the wire together at the base of the immobilizing medium. When inserted into the bottle, the loop lies just below the cap.

Such a device is a rigid member generally incompatible with pill packages which include a tamper-evident seal since the loop is typically centered along the longitudinal center axis of the bottle. This location causes a patient to force the finger grip deeper into the bottle where a patient inserts a finger into the center of the bottle such as typically occurs when a patient or tablet user attempts to puncture the tamper evident inner seal with a finger or other object. In addition, such a device tends to be complex and costly to fabricate due to the twisting and bending required to form and secure the finger grip to the cotton. The fabrication of the device requires numerous complex steps such as cutting the length of the wire, forming the finger grip loop, inserting the immobilizing medium between the end portions, and twisting the distal ends to secure the device to the immobilizing medium. Furthermore, no portion of the device is accessible without the user inserting a finger or other grip into the neck of the device.

The above mentioned content immobilizers also tend to be incompatible with conventional immobilizing medium insertion machines, such as cotton insertion machines, and would typically require substantial changes to conventional pill packaging processes. Conventional automated cotton insertion machines such as a model COTTONER 71 manufactured by Lakso Packaging Company, a division of Package Machinery Company, Massachusetts, and a model KL-8-15 manufactured by Consolidated Manufacturing Company, a Figgie International Company New York, N.Y., typically use cylinders and corresponding plungers for forming and inserting inverted "U" pieces of immobilizing medium similar to machines described in U.S. Pat. Nos. 2,817,934 and 3,030,748 the disclosures of which are hereby incorporated by reference.

A problem arises with known content immobilizers where the handle or closure for coupling to the cotton, can not be readily inserted into the cylinder with the immobilizing medium due to its size or nature of construction. For example, the content immobilizers which require that the handle or closure be coupled to the immobilizing medium at one of the ends of the immobilizing medium would are generally not compatible with the inverted "U" shape formed by conventional insertion machines. Other content immobilizers which require closures with extending structures for gripping the immobilizing medium have larger diameters than the inside diameter of the cylinders and would require redesign of the conventional bottle caps and/or corresponding inner seal.

Where the content immobilizer incorporates a handle or pull grip for coupling to the immobilizing medium instead of using the closure for coupling to the immobilizing medium, a problem arises where the handle is allowed to improperly move or slide with respect to the immobilizing medium. For example, where the handle is allowed to lean too far in a lateral or longitudinal direction with respect to the immobilizing medium, a peripheral edge of the cylinder may pinch the pull grip and cause insertion problems, or may insert the handle below the shoulder and beyond the reach of the patient. This makes it difficult for a patient to locate or access the pull grip.

Therefore, a need exists for a content immobilizer with a pull grip that is capable of being quickly and easily attached to the immobilizing medium and inserted into the bottle to form an easily removable content immobilizer. Furthermore, there exists a need for a content immobilizer which may be economically fabricated and inserted into bottles in a few simple steps. The content immobilizer should be generally compatible with conventional packaging processes and insertion processes. A need also exists for a readily removable content immobilizer having a finger grip that does not penetrate the tamper evident seal or otherwise breach the seal and thereby reduce the effectiveness of such a seal. In addition, a need exists for a content immobilizer which provides out-of-bottle access irrespective of the amount of immobilizing medium in the bottle. A need also exists for a finger pull grip which is not readily pushed into the bottle when the foil tamper-evident seal is punctured.

SUMMARY OF THE INVENTION

These needs and others have been substantially met by the content immobilizer for immobilizing contents in a bottle disclosed herein. The inventive content immobilizer includes an immobilizing medium, such as cotton or the like, insertable through the mouth of the bottle, and grip means, such as an integrally formed plastic pull grip, operatively coupled through the immobilizing medium, wherein the grip means has a flexible portion adapted to resiliently extend above an upper rim surface of the mouth after removal of the closure.

The pull grip may include a first end portion that resiliently extends above the upper rim surface of the mouth and also may have a portion for receiving an immobilizer removing device. The pull grip includes a second end for operatively coupling the grip means to the immobilizing means, and further includes a substantially upright intermediate portion connecting the first end to the second end. The pull grip may also laterally compress and expand to frictionally engage with an interior wall surface of the bottle to secure the pull grip in a predetermined position. The portion for receiving may be adapted to extend away from a center axis of the bottle and proximate a periphery of the inner surface of the bottle. The pull grip may have a stabilizing member for maintaining the grip means in a predetermined position, such as from leaning in a lateral direction or from sliding too far through the immobilizing medium. Other embodiments include the content immobilizer with fewer combinations of the above described features.

The method for immobilizing contents in a bottle includes forming the content immobilizer by inserting the pull grip through the immobilizing medium, the pull grip being adapted to extend out through the mouth of the bottle, inserting the content immobilizer into the bottle such that at least a portion of the pull grip extends out through the mouth of the bottle, and applying a closure, such as a tamper evident seal, a cap and/or both, over the mouth such that the portion of the pull grip resiliently couples to a bottom surface of the closure. The pull grip may be adhesively coupled to the bottom surface of the closure by passing the bottle with inserted content immobilizing medium and closure through a thermal energy emitting machine as known in the art.

BRIEF DESCRIPTIONS OF THE DRAWINGS

FIG. 1A generally illustrates a pill bottle having a tamper-evident seal closure wherein the bottle contains a content immobilizer in accordance with the invention;

Figure 3:
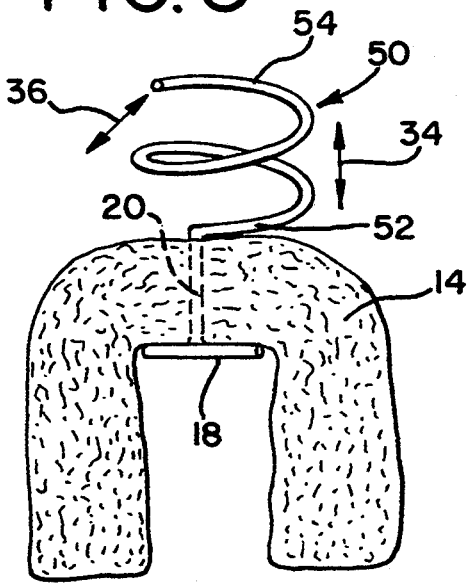
Figure 4:
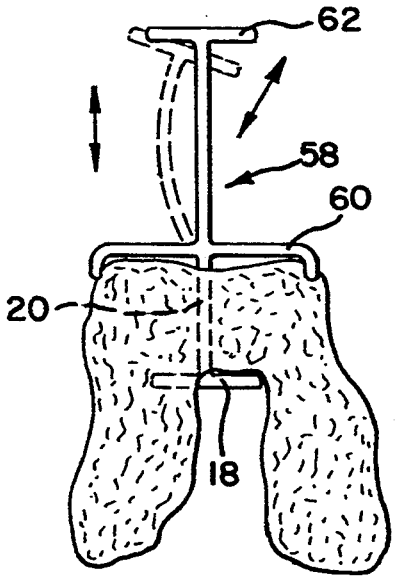
Figure 5:
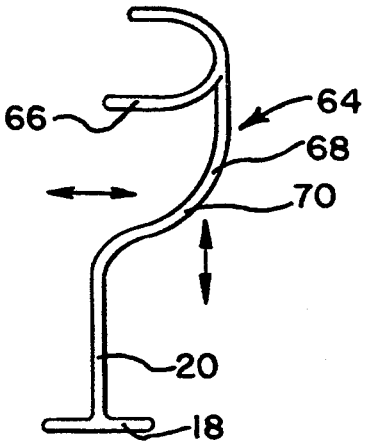
Figure 6:
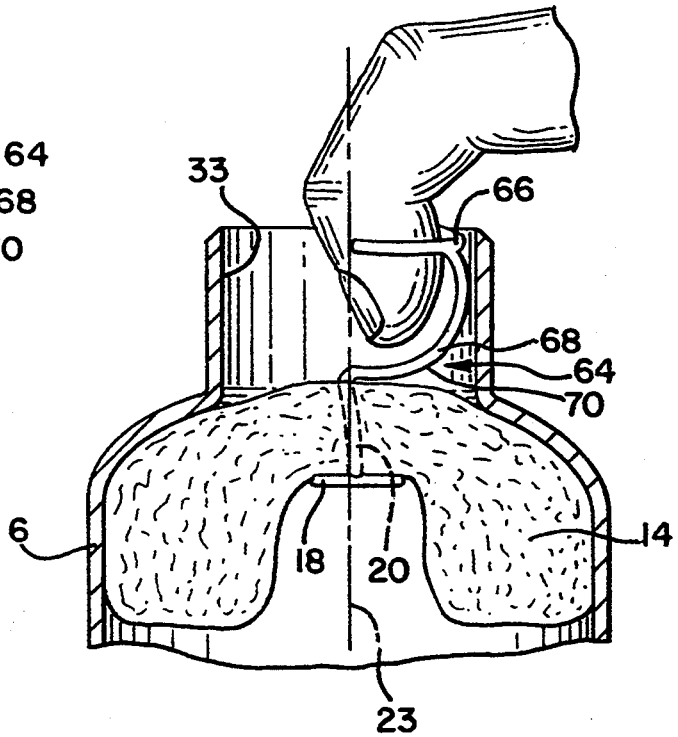
Figure 7:
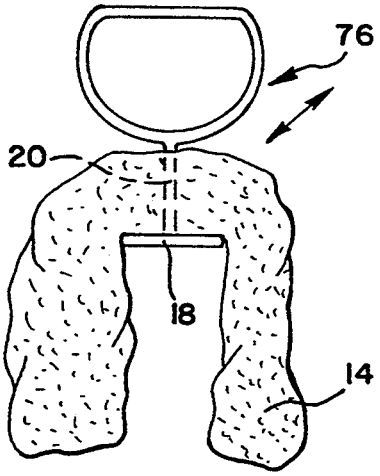
Figure 8:
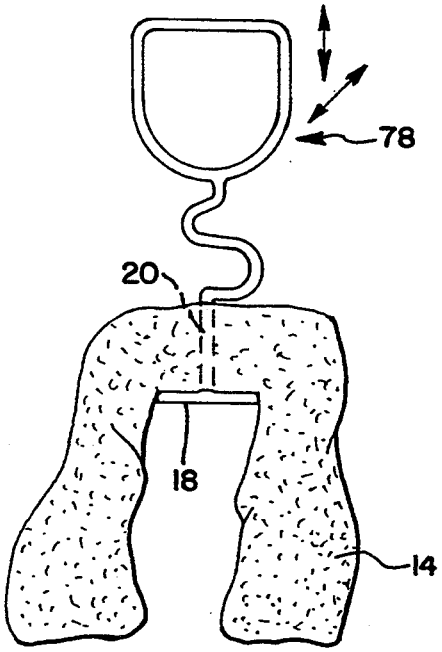

FIG. 3 generally depicts another embodiment of a content immobilizer in accordance with the invention;

FIG. 4 generally depicts yet another embodiment of a content immobilizer in accordance with the invention;

FIG. 5 generally depicts an embodiment of a pull grip used in the immobilizer in accordance with the invention;

FIG. 6 is a cross-sectional view of a pill bottle containing a content immobilizer in accordance with the invention using the grip means of FIG. 5;

FIG. 7 generally depicts yet another embodiment of a content immobilizer in accordance with the invention;

FIG. 8 generally depicts yet another embodiment of a content immobilizer in accordance with the invention; and FIGS. 9A and 9B generally illustrate the content immobilizer in accordance with the invention being inserted into a cylinder for later insertion into a bottle.

DESCRIPTION OF THE PREFERRED EMBODIMENTS

Figure 1A:
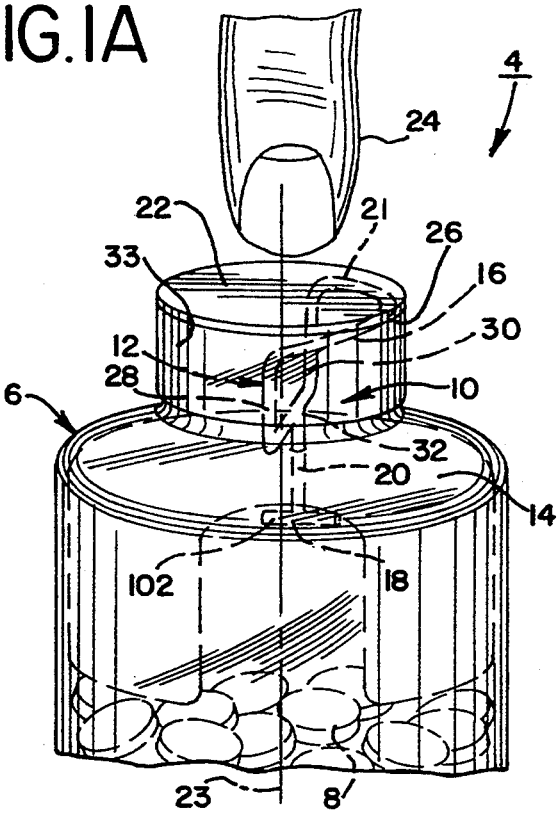
FIG. 1B is a front elevational view of the pull grip of FIG. 1A in accordance with the invention.

FIG. 1A shows a package 4 for pills or the like having a pill bottle 6 filled with pills or tablets 8 protected by a content immobilizer 10. The content immobilizer 10 includes a resilient invasive pull grip 12 or handle, inserted through a piece of immobilizing medium 14 such as a piece of cotton, rayon, polyester, cellophane, or other suitable immobilizing medium. The invasive pull grip 12 may be integrally formed as a unitary member and includes a pull grip portion 16, an immobilizing medium coupling section 18, such as a "T" shaped end portion, and an intermediate support section 20, such as an axially upright portion. The pull grip 12 is considered invasive since it passes through the immobilizing medium 14.

The invasive pull grip 12 may be molded from a plastic such as a polyvinyl resin or a thermoplastic polymer such as polyethylene, or polyurethane, or nylon, or any other suitable substance having resilient flex qualities for reasons to be described later. Where possible it may be desirous to make the pull grip 12 from the same material as the bottle 6. Also, where the content immobilizer 10 is used in pharmaceutical applications, it may be desirable to choose a material compatible with regulatory requirements to minimize stability effects of the content immobilizer 10.

The grip portion 16 has a section 21 for receiving a finger or other immobilizer extraction device. The section 21 for receiving includes an arcuately shaped portion which extends radially from the longitudinal center axis 23 of the bottle. The intermediate support section 20 couples to a plurality of substantially upright axially extending arms 28 and 30 which extend in a substantially parallel plane with respect to the center axis 23 of the bottle 6 as shown. The arms 28 and 30 form an obtuse angle with the grip portion 16, but may be formed at any suitable angle such as perpendicularly to the finger grip portion 16.

The section 21 for receiving a finger connects the arms 28 and 30 together at one end of the arms 28 and 30. The other ends of arms 28 and 30 are connected together by a laterally extending member 32. The laterally extending member 32 is formed above the intermediate support section 20 to allow sufficient room between the end of the coupling section 18 and the extending member 32 for the thickness of the immobilizing medium. In addition, the laterally extending member 32 serves as a stabilizing member to facilitate lateral stabilization of the pull grip 12 after the pull grip 12 is inserted through the immobilizing medium 14 so that the pull grip 12 does not lean too far in a lateral direction and also provides longitudinal stabilization so the pull grip 12 does not slide too far through the immobilizing medium 14. It will be recognized that the dimensions of the stabilizing member may be widened or otherwise modified to produce the desired stability.

The section 21 for receiving a finger or extraction device may have a substantially circular cross-section or any suitable cross-section. The section 21 for receiving may conform generally to the annular shape of the interior of the inside surface 33 of the neck of the bottle and extends away from the center axis 23 of the bottle 6 to the periphery of the interior side wall of the neck. This allows the content immobilizer 10 to be readily inserted and removed from the pill bottle 6. The section 21 for receiving also provides clearance for a finger or other object to freely enter into the neck of the bottle thereby keeping the content immobilizer 10 from being pushed deeper into the neck upon axial insertion of a finger or other object which typically occurs during puncture of an inner tamper evident seal 22 (best seen in FIG. 6). It will be recognized that a shape other than a arcuate portion may also be used which allows an extraction device to axially enter the bottle without pushing the grip 16 into the bottle 6. The tamper evident seal 22 has a bottom surface 26 which may include a layer of thermally activated adhesive or other suitable film for adhering the perimeter of the seal 22 to the rim of the bottle as known in the art.

Figure 1B:
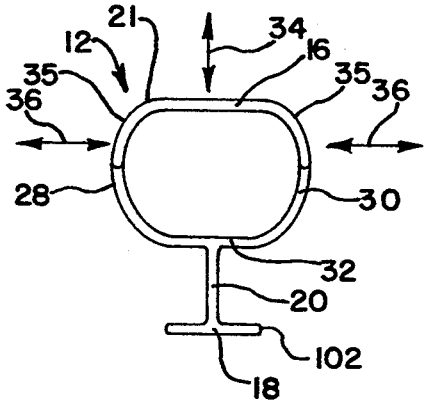

The pull grip 12 is formed so that at least a portion, such as the section 21 for receiving, resiliently springs-out and extends above the rim of the bottle after the closure 22 (seal or cap) is completely or partially removed. For example, after the inner foil seal is punctured or removed or after a cap 44 is removed (where no inner foil seal is used). The longitudinal length of the pull grip 12 is such that when the pull grip 12 is not compressed in the longitudinal direction of arrow 34 (as seen in FIG. 1B) by the inner seal, the portion above the immobilizing medium is long enough to extend above the rim to facilitate out-of-bottle access.

Variations in material composition, cross-sectional shape and area of the finger grip or pull grip, and available unfilled space inside the bottle are all variables that should be considered. For example, the amount of pills in the bottle may affect how far into the bottle the content immobilizer may be inserted. Where the amount is small such that half of the bottle is filled, the grip 12 may be lengthened or otherwise formed to insure that a portion resiliently protrudes above the rim of the bottle. From the foregoing, it is evident that the resilient spring-like action provides out-of-bottle access to the pull grip portion 16 and facilitates removal of the immobilizing medium without requiring a patient or user to insert a finger or other object into the bottle to remove the immobilizing medium.

The coupling portion 18 and the intermediate support section 20 are preferably of dimensions and flexibility suitable for use with a manually operated hollow needle insertion device, such as disclosed in U.S. Pat. No. 3,103,666 and incorporated herein by reference. Some commercially available tools include a model 3030 TAGGER TAIL (trademark) fastener available from Monarch Marking, Dayton, Ohio or a PISTOL-GRIP (trademark) fastener tool available from Dennison Manufacturing Company, Framingham, Mass.

The pull grip 12 may be manually attached to the immobilizing medium using such tools prior to forming the immobilizing medium in an inverted "U" as previously described. These tools are known in the art of attaching price tags to clothing through the use of a nylon fastener having a "T" shaped end. These tools have a hollow needle having a "C" shaped cross section formed by a slot extending longitudinally along the length of the hollow needle. Inside the hollow needle is a channel for receiving the coupling portion 18. Where the immobilizing medium is a thick cotton or the like, it is preferable that the immobilizing medium be compressed before the needle is inserted through the immobilizing medium. The coupling portion 18 is forced through the channel and exits through an opening of the needle in a similar manner as the nylon fastener having a "T"-shaped end. However, it will be recognized that any suitable technique for inserting the coupling portion through the immobilizing medium may also be used.

FIG. 1B illustrates a front view of the pull grip 12 of FIG. 1A and shows the generally axial flex direction 34 and an additional lateral flex direction 36 which may be included in the pull grip 12 as facilitated by the resilient nature of the material from which the pull grip 16 is molded. The advantage of providing lateral flexibility will be discussed with reference to FIG. 2. The pull grip portion 16 and the arms 28 and 30 form a curved top area 35 which allows a cylinder to more readily slide over the pull grip 12 as will be further described with reference to FIGS. 9A and 9B.

The resilient pull grip 16 is preferably designed to attach to an area intermediate distal ends of a piece of immobilizing medium. This facilitates adaptability to existing cotton insertion methods such as the inverted "U" method since the heel of the inverted "U" is generally the area which is accessible though the mouth of neck of the bottle. However, any suitable location may be employed.

Figure 2:
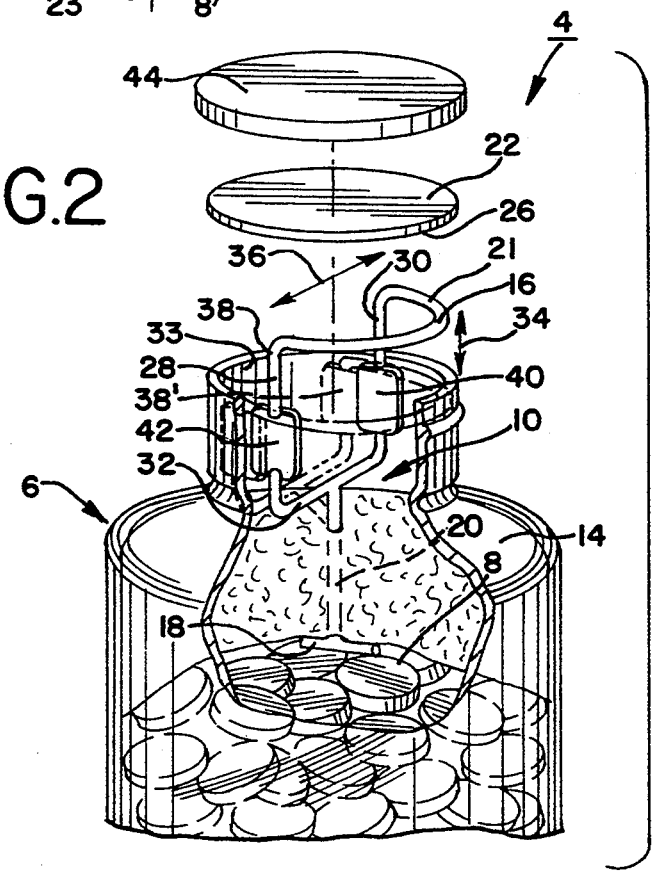
FIG. 2 is a cut-away view of a pill bottle having a tamper evident seal and cap closure wherein the bottle contains another embodiment of the content immobilizer in accordance with the invention.

FIG. 2 shows another embodiment of a pull grip 38 similar to the pull grip 12 of FIGS. 1A and 1B and includes side panels 40 and 42 formed as part of the arms 28 and 30. The side panels 40 and 42 have a slight arcuate cross section which frictionally cooperates with the curved interior surface 33 of the bottle. The pull grip 38 also flexes in the lateral direction 36 such that the arms 28 and 30 are compressible toward and away from the center axis of the bottle 6. The package 4 includes a cap 44 which covers the inner seal 22 as known in the art. The pull grip 38' shown in dashed lines is compressed into the bottle 6 after a seal 22 and a cap 44 has been applied to the bottle. The arms 28 and 30 frictionally secure the pull grip 12 proximate the mouth in a predetermined orientation inside the bottle.

The panels 40 and 42 have an outside surface which frictionally engages the interior surface 33 of the neck of the bottle 6 as shown. The panels 40 and 42 provide a greater surface area to frictionally engage the interior wall surface 33 of the neck of the bottle. As mentioned above, the frictional engagement secures the pull grip 12 and hence the pull grip portion 16 in a predetermined position, such as a selected lateral position proximate the top of the bottle. Furthermore, the pull grip 12 is substantially prevented from moving during transport.

FIG. 3 shows an alternative embodiment of a content immobilizer having a helical grip portion 50. The helical pull grip portion 50 includes a base 52 and a top 54. The base 52 couples to one end of the intermediate support section 20. The top 54 serves as the pull grip portion 16 as previously described. The helical configuration facilitates removal of the content immobilizer without allowing the pull grip to be forced further down into the bottle, similar in effect to the arcuate shape of the pull grip portion 16. Again, the pull grip 50 is adapted to provide flexibility in a generally axial direction and flexibility in a generally lateral direction.

FIG. 4 shows another embodiment of a content immobilizer with a substantially upright resilient pull grip 58 with a stabilizing member 60 and a "T" shaped pull grip portion 62. The pull grip 58 may bend as shown in the dashed lines to facilitate spring-like out-of-bottle access. The stabilizing member is positioned between the pull grip portion 62 and the coupling portion 18 to prevent the intermediate portion, and hence the pull grip portion 62, from sliding too far through the immobilizing medium. The stabilizing member may also be flattened to provide additional lateral stability.

FIGS. 5 and 6 show yet another embodiment of a content immobilizer having a resilient pull grip 64 with an arcuate pull grip portion 66 and a single arm 68 formed between the coupling portion 18 and the pull grip portion 66. The arm 68 includes an elbow portion 70 which serves as the stabilizing member. The pull grip 64 flexes about the elbow 70 to facilitate axial movement of the pull grip 64. FIG. 6 shows the content immobilizer compressed in the bottle 6.

FIGS. 7 and 8 illustrate other embodiments of a content immobilizer with a resilient pull grip 76 and 78. Both pull grips 76 and 78 extend in axially extending upright planes and do not have a portion of the finger grip portion formed in a horizontal plane such as those of FIGS. 1–6. The pull grip 76 of FIG. 7 is resilient primarily in the lateral direction 36 whereas the pull grip 78 of FIG. 8 is resilient in either the axial or lateral directions.

Figure 9A:
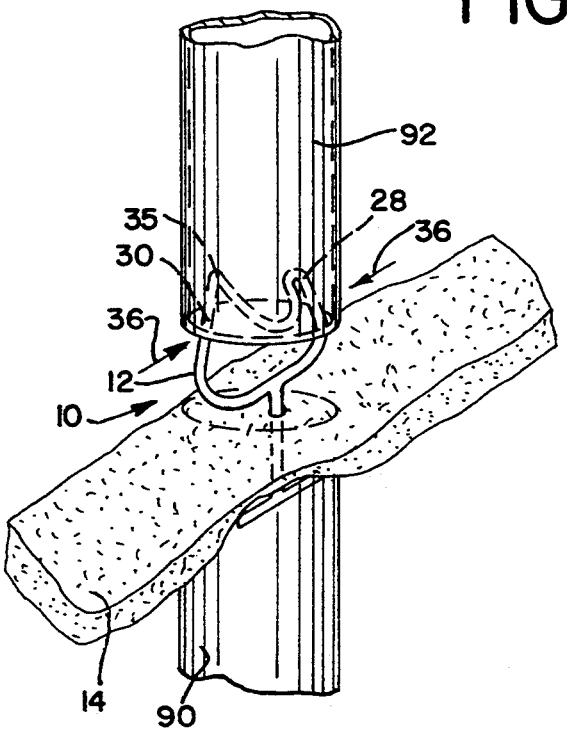
Figure 9B:
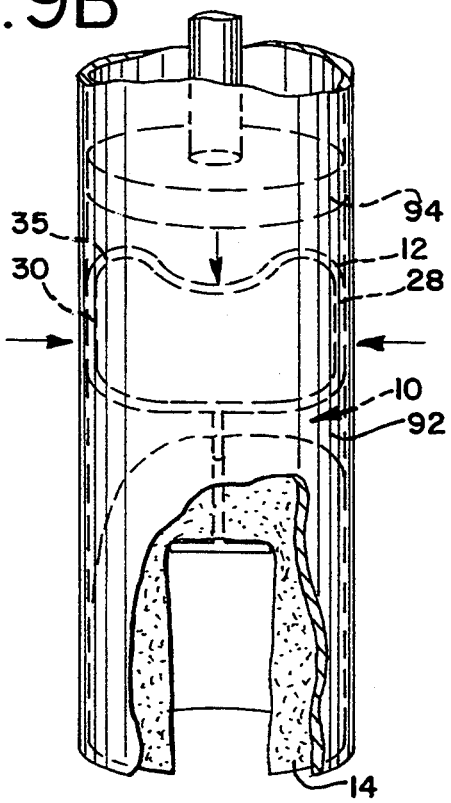

FIGS. 9A and 9B generally show the content immobilizer 10 of FIG. 1 being inserted into a cylinder 92 as known in the art, to form the immobilizing medium in an inverted "U" shape. The content immobilizer 10 is positioned on an anvil 90 or other holding device, under a cylinder 92 and a corresponding plunger 94. As shown in FIG. 9A, the cylinder 92 is in its retracted position. As shown in FIG. 9B, the cylinder 92 extends over the pull grip 12 and the immobilizing medium 14 causing the immobilizing medium 14 to be formed in an inverted "U". As the cylinder 92 extends over the pull grip 12, the arms 28 and 30 are resiliently forced laterally inward toward the center of the cylinder 92. The rounded edges 35 allow the end of the cylinder 92 to readily pass over the pull grip 12. The plunger 94 may then force the content immobilizer 10 into the bottle as known in the art. The arm 28 and 30 expand laterally outward inside the bottle and frictionally engage the interior surface 33 of the neck of the bottle.

The axial spring action of the finger grip portion 16 allows the pull grip portion 16 to resiliently couple to a bottom surface 26 of the seal 22 through the flexible attributes of the material used to form the pull grip 16. Consequently, the foil seal application process and the capping process is unaffected. The foil seal remains as a unitary piece forming a complete seal about the rim of the mouth. The finger grip portion 16 may be adhesively attached to the bottom surface 26 particularly where the seal 22 has an adhesive layer as its bottom surface 26. As known in the art, such seals typically have a thermal or pressure sensitive layer so that the bottom 26 of the seal may be tightly secured to the entire rim of the bottle 6.

The pills may be packaged using the content immobilizer 10 by filling the bottle with a suitable number of pills or the like and forming a content immobilizer by coupling the pull grip 12 to the immobilizing medium 14. The content immobilizer 10, having a portion adapted to extend out through the mouth of the bottle 6, such as the finger grip portion 16, is inserted into the bottle by the cylinder 92 and plunger 94 or other suitable device such that at least a portion of the pull grip extends out through the mouth of the bottle. The seal 22 may then be applied over the mouth such that the portion of the pull grip 12 resiliently couples to the bottom surface 26 of the seal 22.

Where the adhesive layer on the seal secures the seal to the rim by induction heating or other thermal energy generating technique, the grip portion 16 will attach to the adhesive layer thereby securing the pull grip 12 to the closure. It will be recognized that attachment of the pull grip to the closure is not necessary to facilitate removal of the immobilizing medium since the closure is distinct from the content immobilizer, i.e., that the closure may be removed without removing the immobilizing medium. It will also be recognized that the pull grip 12 may be made from the same or different materials than the bottle and still couple to the adhesive layer.

Coupling a portion of the pull grip 12 to the bottom of the seal 22 helps prevents the finger grip portion 16 and hence the content immobilizer from shifting in the bottle after packaging is completed. Also, the finger grip portion 16 is secured to the seal during puncture of the seal so that the pull grip 12 cannot be as readily forced back into the bottle when the pills are initially removed.

After insertion of the content immobilizer 10 into the bottle, the finger grip may be secured to the bottom surface of the foil seal to reduce the probability that the finger grip will be forced too far into the bottle when the foil seal is removed. Securing of the pull grip to the foil seal makes it easier to locate the pull grip after the seal has been punctured or broken.

The resilient feature of the inventive pull grip allows the finger grip section to be automatically secured to the bottom section of the foil seal without substantially varying the standard induction heating process used to seal the foil to the rim of the bottle during the capping process. Both the pull grip and the foil seal may be simultaneously secured to their respective cooperating surfaces in one step.

Further, it will also be recognized by those skilled in the art that where pressure sensitive foil seals are used to secure the foil seal to the rim, the resiliency and contact surface of the pull grip may be modified accordingly to so that adequate pressure and contact surface area exists between the pressure sensitive seal and the finger grip to facilitate proper securing between the foil seal and the pull grip.

It will be recognized that many variations may be employed to suit a particular application. For example, where the immobilizing medium is inserted such that is rises above the shoulder of the bottle and nearly flush with the closure, a shorter pull grip may be necessary. Also, the pull grip may be colored to be more readily visible to a user once the seal is punctured or removed. Those skilled in the art will further recognize that any single feature as disclosed herein or any suitable combination of features may be employed with a given content immobilizer. For example, a content immobilizer may have a grip portion shaped to extend away from the center axis of the bottle but may not be flexible in the axial direction to provide out-of-bottle access. Another content immobilizer may have lateral flex capabilities but may not have axial flex capabilities. Such variations will allow variations in the material with which the pull grip is formed. For example, the pull grip may be formed from a bio-degradable composite material which has minimal flex properties.

What is claimed is:

1. A package having, in combination, a container for holding loose articles, and a content immobilizing device for immobilizing the loose articles in the container, wherein the package comprises:

said container having a body with an open top for dispensing the articles;

and said device having an elongate, foldable, compressible immobilizing medium for placement between the loose articles and the open top for immobilizing the loose articles; and a flexible, invasive plastic grip member, passing through the foldable immobilizing medium, having a pull grip end connected to a "T" shaped coupling end by an intermediate support section.

2. The package of claim 1 wherein the intermediate support section has a curved portion that connects with the pull grip end.

3. The package of claim 1 further including laterally disposed stabilizing means positioned above the foldable immobilizing medium and intermediate the pull grip end and the "T" shaded coupling end and, for maintaining the grip member in a predetermined position.

4. The package of claim 3 wherein the stabilizing means includes a stabilizing member which operatively couples to the immobilizing medium.

5. The package of claim 1 wherein the content immobilizing medium is folded in an inverted "U".

* * * * *